United States Patent [19]

Maeda et al.

[11] Patent Number: 4,711,501

[45] Date of Patent: Dec. 8, 1987

[54] ROCK CRUSHING DEVICE

[75] Inventors: Akiya Maeda, Tondabayashi; Mituya Sakai, Kashihara; Yukinobu Masaka; Masahiro Nomura, both of Ichinomiya; Yasuo Yamada, Seki; Tetsuro Tatsuhama, Osaka, all of Japan

[73] Assignees: Okumura Machinery Corporation, Osaka; Seibu Polymer Kasei Kabushiki Kaisha, Tokyo, both of Japan

[21] Appl. No.: 759,361

[22] Filed: Jul. 26, 1985

[30] Foreign Application Priority Data

Jul. 30, 1984 [JP] Japan ..... 59-117790[U]
Jul. 30, 1984 [JP] Japan ..... 59-117791[U]

[51] Int. Cl.[4] ..... F21C 37/10
[52] U.S. Cl. ..... 299/21; 166/187
[58] Field of Search ..... 299/20, 21; 166/177, 166/187, 212, 281, 308

[56] References Cited

U.S. PATENT DOCUMENTS

| | | | |
|---|---|---|---|
| 1,630,470 | 5/1927 | Clifford | 299/21 |
| 1,863,286 | 6/1932 | Sheppard | 299/21 |
| 1,879,907 | 9/1932 | Meyer | 299/21 |
| 1,915,687 | 6/1933 | Meyer | 299/21 |
| 2,133,730 | 10/1938 | Brundred | 166/187 |
| 2,211,243 | 8/1940 | Meyer | 299/21 X |
| 2,211,478 | 8/1940 | Pierce | 299/21 X |
| 2,231,282 | 2/1941 | Norris | 166/187 |
| 2,238,058 | 4/1941 | Johnson et al. | 299/21 X |
| 4,349,047 | 9/1982 | Ditto et al. | 166/187 X |

FOREIGN PATENT DOCUMENTS

| | | | |
|---|---|---|---|
| 868135 | 7/1949 | Fed. Rep. of Germany . | |
| 875331 | 7/1949 | Fed. Rep. of Germany . | |
| 1165947 | 12/1962 | Fed. Rep. of Germany . | |
| 1299266 | 7/1969 | Fed. Rep. of Germany . | |
| 61-32293 | 2/1966 | Japan . | |
| 60-16695 | 1/1985 | Japan . | |
| 61-6595 | 1/1986 | Japan . | |
| 459815 | 1/1937 | United Kingdom | 299/21 |

*Primary Examiner*—Stephen J. Novosad
*Assistant Examiner*—David Bagnell
*Attorney, Agent, or Firm*—Birch, Stewart, Kolasch & Birch

[57] ABSTRACT

A rock crushing device according to the present invention is designed to crush rocks by the use of the expansion pressure generated when an elastic expandable member of a cylindrical configuration is expanded by pressure fluid to be injected into looped pockets provided within the elastic member. The elastic member, made of rubber or similar materials, is provided tightly to cover around a metal shaft having a fluid passage to introduce pressure fluid into the looped pockets of the elastic member.

22 Claims, 13 Drawing Figures

ROCK CRUSHING DEVICE

BACKGROUND OF THE INVENTION

1. Field of the Invention

The present invention relates to a device for crushing rocks by the utilization of fluid pressure and more particularly, to a device for crushing a rock or concrete by the insertion thereof into a borehole formed in the rock or the concrete to be crushed.

2. Description of the Prior Art

Generally, a blasting method has been most commonly used for crushing rocks or concrete which, however, is disadvantageous in that noise and dust are inevitably generated upon blasting to affect not only the environmental conditions but also the operation conditions in the pit, inducing critical influences on safety in operation. Therefore, a rock crushing method has been strongly desired that can reduce the amount of noise, vibrations and/or dust generated at crushing, when compared with the prior art crushing method.

From the above viewpoint accordingly, there has been a method in recent years that rocks to be crushed (hereinafter referred to as an object to be crushed) are preliminarily formed with boreholes before being crushed, and then, a fluid material is pumped into the boreholes. This method which utilizes the pressure of the fluid material is called a collapse method. According to this collapse method, however, if there is observed any crack or any crevice in the object to be crushed, a serious problem occurs in that necessary pressure for crushing the object to be crushed cannot be obtained because of the leakage of the pressure fluid out of the crack portion.

In another method, a limy filling is used for crushing. The limy filling which has been preliminarily plugged into the boreholes formed in the object to be crushed is expanded through chemical action, and thereby the object statically crushed. According to this method, however, it takes a relatively long time for the limy filling to be expanded through chemical action, and therefore, it is disadvantageous due to low operational efficiency and high operational cost.

Furthermore, in the prior art crushing methods as described above, the crushing force against the wall of the boreholes acts approximately uniformly on the object to be crushed in the circumference of the boreholes, and many cracks are generated on the object to be crushed. As a result, in the case of a tunnel excavation employing the prior art crushing method, for example, the wall surface of the tunnel of a desired shape is formed with many cracks to be a coarse and rough surface, with the ground around the tunnel being loosened, and therefore, it is inconvenient that the prior art crushing method needs a taking-out operation under guidance or many coatings with concrete.

Consequently, in a tunnel excavation which requires the destruction of the object to be crushed in accordance with the predetermined line, such a method as explained in FIG. 1 is employed in which a lot of holes (not shown in the drawings) are plugged at a given interval along the shape of the tunnel, into which each hole is injected a jet of water of high pressure to connect with the other holes so as to form slits H to be provided along the predetermined line, and then a blasting powder is inserted into the blast hole S for blasting. However, since this method requires an additional operation for forming the slits in the blast hole, the crushing operation becomes complicated, and moreover, since this method is accompanied with blasting, the generation of noise and/or vibrations cannot be avoided.

SUMMARY OF THE INVENTION

The present invention has been developed with a view to substantially solving the above-described disadvantages or inconveniences inherent in the prior art crushing methods, and has for its first object to provide an improved crushing device which can accomplish a desired crushing of an object in a relatively short period of time under favorable operational environments with no generation of noise and/or vibrations.

Another object of the present invention is to provide an improved crushing device of the type referred to above which is designed to crush rocks in the manner that after a metal shaft covered with a cylindrical elastic expandable member, such as a rubber tube, is inserted into the borehole formed in the rock to be crushed, the cylindrical elastic expandable member is expanded by the pressure fluid thereby to crush the rock by the pressure of the expansion.

In accomplishing these and other objects, according to one preferred embodiment of the present invention, there is provided an improved rock crushing device to be inserted into a borehole formed in a rock for crushing the rock on the application of fluid pressure thereto comprising: a shaft of a length provided along its center axis with a fluid passage, one end of which is opened at the end of the shaft to be connected to a pressure fluid source, while the other end of the passage is provided with an outlet open to the outside at the middle of the outer peripheral surface of the shaft, an elastic member made of expandable material in a cylindrical shape having an outer diameter capable of being inserted into the borehole of a rock with a small gap and an inner diameter capable of receiving the shaft therein in a tight relationship therebetween, and provided with at least a pair of looped pockets each disposed within the middle portion of the elastic member opposite to the other in the axial direction of the elastic member and expandable upon receiving fluid pressure therein. The looped pockets have ports disposed at positions biasing to the center on the inner surface of the elastic member in such a manner that pressure fluid is supplied from the outlet of the shaft into the looped pockets through the ports without discharging to the outside. A pair of fixtures are each mounted on the shaft at the respective end of the elastic member so as to prevent the elastic member from expanding along the axial direction of the shaft beyond the fixtures, whereby the elastic member is constrained to expand only in its radial direction to crush the rock when the pressure fluid is supplied into the pockets of the elastic member.

According to another preferred embodiment of the present invention, a crushing device comprises an elastic expandable member in a cylindrical configuration formed with looped pockets between the inner and outer peripheral surfaces thereof, the looped pockets having ports at the side of the inner peripheral surface of the end portions of the elastic member and extending towards the end portions, a metal shaft having an introduction passage for pressure fluid at the center thereof, the elastic member being inlaid in the outer periphery of the shaft such that at least the inner peripheral surface of the end portions of the elastic member is closely adhered to the shaft, and an elastic ring harder than the elastic member fixedly connected to the end faces of the elastic member by a fixture of a smaller diameter than the elastic ring, wherein pressure fluid is injected from the fluid passage formed in the shaft to the inner peripheral side of the elastic member so as to expand the elastic member in the direction of an outer periphery thereof, thereby crushing an object.

BRIEF DESCRIPTION OF THE DRAWINGS

These and other objects and features of the present invention will become apparent from the following description taken in conjunction with the preferred embodiments thereof with reference to the accompanying drawings, wherein.

DETAILED DESCRIPTION OF THE INVENTION

Figure 1:
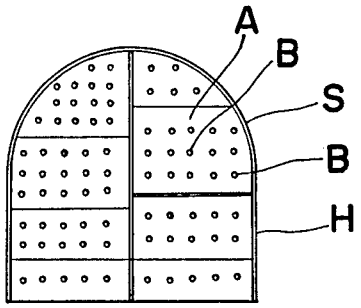
FIG. 1 is a view of a tunnel formed with a blast borehole and slits therein.

Before the description proceeds, it is to be noted that like parts are designated by like reference numerals throughout the accompanying drawings.

Figure 2:
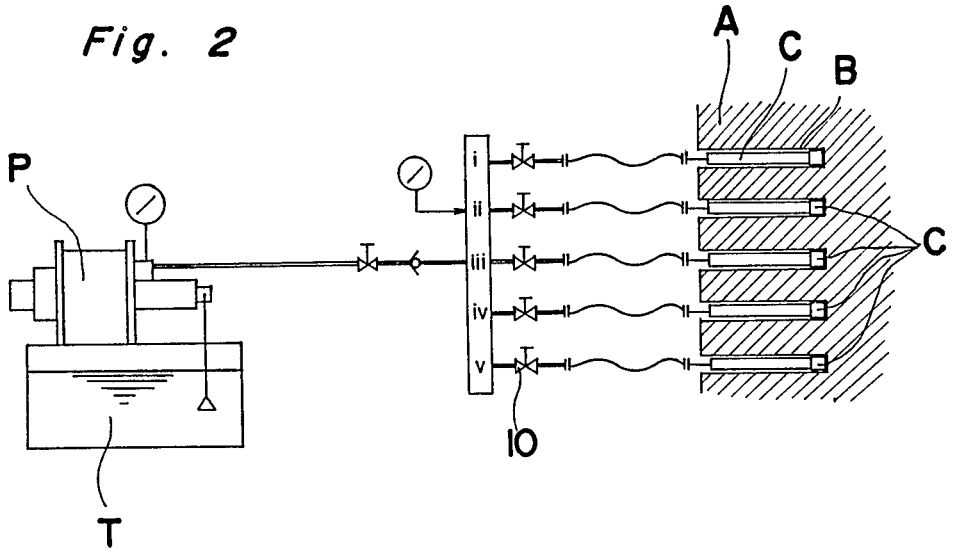
FIG. 2 is a schematic diagram showing a plurality of crushing devices for use in practice according to the present invention.

It is also to be noted here that although the crushing device C of the present invention is most effective when it is used in the manner as shown in FIG. 2, the following description will be directed to the case where only one crushing device is employed.

Figure 3:
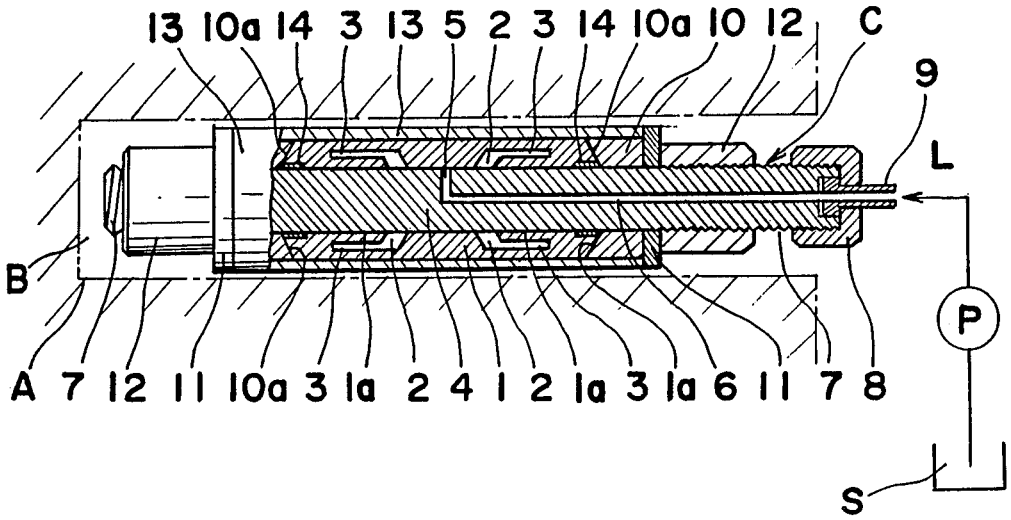
FIG. 3 is a cross-sectional view of the present crushing device when being inserted into a borehole of an object to be crushed.
Figure 4:
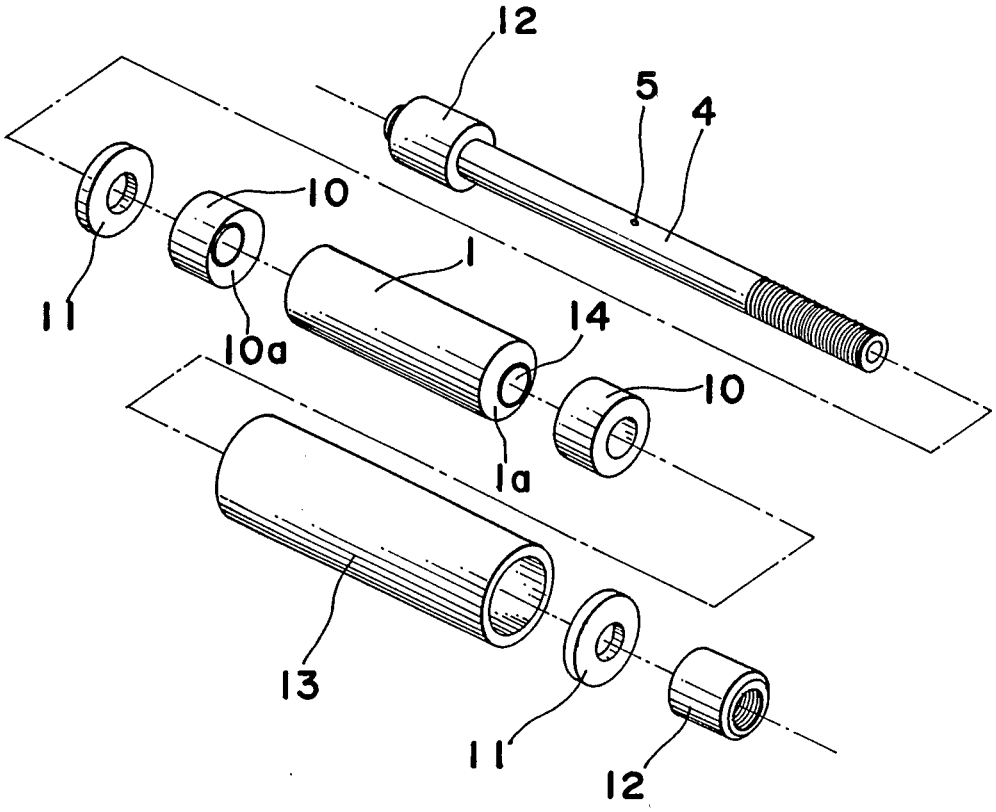
FIG. 4 is a perspective view of the parts of the crushing device of FIG. 3.
Figure 5:
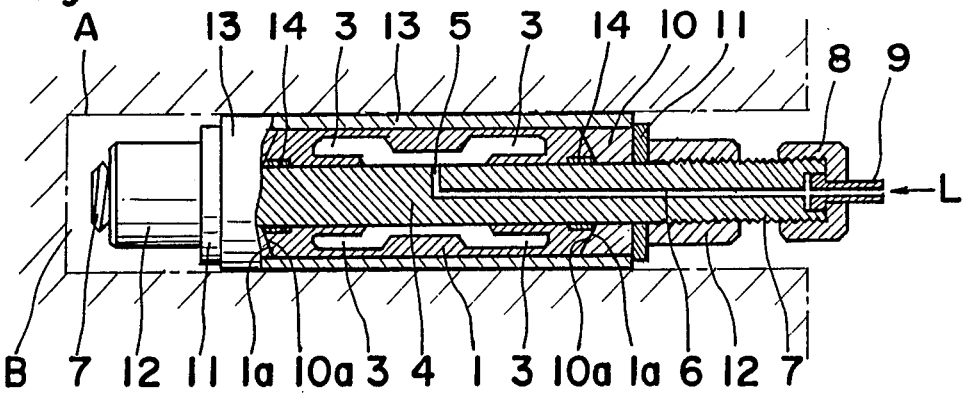
FIG. 5 is a cross-sectional view of the crushing device when an elastic expandable member therein is expanded.

Hereinafter, the crushing device of the first embodiment will be described with reference to FIGS. 3 and 5 including an elastic member 1 detachably mounted on a shaft 4 with sealing means. The elastic member 1 is made of materials such as rubber, or some expandable synthetic resin in the configuration of a cylinder, with tapering end faces 1*a* outwardly extending at opposite end portions thereof. Within the elastic member 1 a pair of looped pockets 3 are provided between the inner and outer peripheral surfaces facing each other and extending along the axial direction towards the opposite end portions of the elastic member 1. The pockets 3 have ports 2 disposed on the inner periphery with biasing to the center of the elastic member 1 for receiving liquid into the pockets 3. As shown in the drawings, the pockets 3 of the elastic member 1 have L-shaped cross-sections with portions of the elastic member 1 provided between the pockets 3 and the inner peripheral surface except for the ports 2 to be adapted to form seals for pressure liquid. The shaft 4 to be employed as a solid core member having a given length and a circular cross-section is made of rigid materials such as metal or hard synthetic resin and is provided at its central portion with a slot passage 6 for introducing pressure fluid from an inlet opening at the outer end surface of the shaft 4 to be coupled with a liquid source to an outlet 5 opening at the outer peripheral surface of the intermediate portion of the shaft 4 to communicate with the ports 2 of the pocket 3 of the elastic member 1. Also, threads 7 are provided at both end portions of the shaft 4 to secure detachable fixtures 12, respectively, for positioning both ends of the elastic member 1 inlaid on the shaft 4 at given positions in the middle portion of the shaft 4. The shaft 4 is forcibly inserted into the inner peripheral surface of the elastic member 1, so that the elastic member 1 is inlaid onto the middle portion of the outer periphery of the shaft 4 so as to be tightly adhered with each other establishing a communication between the ports 2 of the pockets 3 of the elastic member 1 and the outlet 5 of the passage 6 of the shaft 4. The sealing means includes a pair of elastic rings 10, metal washers 11 and metal rings 14, and a cover tube 13.

Figure 6:
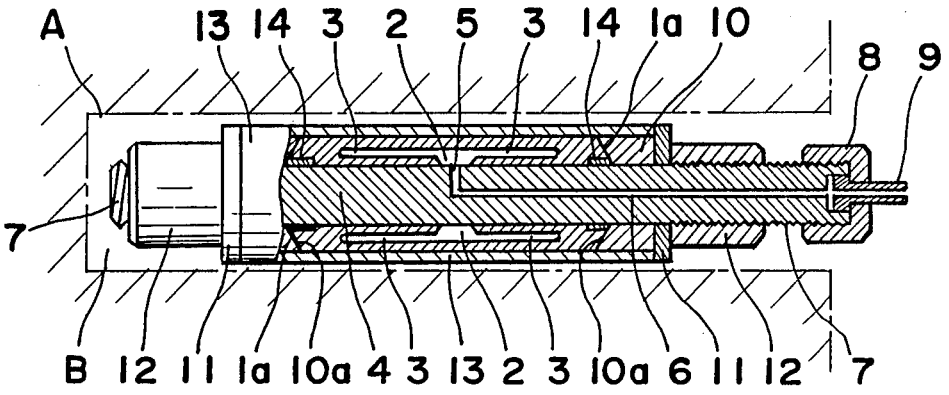
FIGS. 6 to 13 are respectively cross-sectional views of a crushing device according to other embodiments of the present invention.

The elastic rings 10 are made of materials more rigid than the elastic member 1 and have the same outer diameter of the elastic member 1, provided with tapered faces at the ends corresponding to the tapered end faces of the elastic member 1. Each of the elastic rings is provided between the outer end of the elastic member 1 and the metal washer 11 backed up by the fixture 12 secured onto the thread 7 of the shaft 4, so that the tapered face of the elastic ring 10 is tightly attached with the tapered end faces of the elastic member 1 in order to prevent the outer end of the elastic member 1 from warping. In other words, the elastic ring 10 is assembled to press against the elastic member 1 from the outside through the metal washer 11 having a similar or smaller diameter than the elastic ring 10 by the fixture 12 of a round nut type having a smaller diameter than the elastic ring 10. Moreover, the elastic member 1 is closely covered with the cover tube 13 made of elastic material for the protection of the outer peripheral surface over the whole length thereof. The protection cover tube 13 is made of extensible reinforcement material such as a spiral spring or the like and is provided onto the outer periphery of the elastic member 1. The pair of metal rings 14 are formed as circular strips made of rigid material harder than the elastic member 1 made of metal, bead wire, reinforcing fabric and the like, and are respectively provided at both of the end portions of the elastic member 1 in order to prevent the elastic member 1 from warping at the end portions when applying pressure fluid into the pockets 3 of the elastic member 1. The metal ring 14 is embedded integrally within the elastic member 1 so that its one is disposed toward the elastic ring 10 and the other end toward the outer peripheral surface of the shaft, but the metal ring 14 may be provided to embed completely into the elastic member 1. Although it is illustrated in FIG. 3 that a pair of the looped pockets 3 associated with ports in the elastic member 1 are formed separately from each other at both sides of the elastic expandable member 1, a groove may be formed, as shown in FIG. 6, between the inner peripheral surface of the elastic member 1 and the outer peripheral surface of the elastic member 1 and the outer periphery of the shaft 4 for connecting the ports 2 as one unit at the inner peripheral side of the elastic member 1.

Moreover, the metal washer 11 and the fixture 12 may be integrally formed. It is enough, with no particular limitation to the configuration of the fixture 12, if it only has a smaller diameter than the elastic member 1. In the drawings, a reference A represents an object to be crushed, and a reference B represents a borehole formed in the object A to be crushed. The internal diameter of the borehole B is considerably larger than the external diameter of the elastic member 1. The crushing device comprising the elastic member 1 and the shaft 4 is inserted into the borehole B for use.

As is clear from the foregoing description, in the crushing device of the present invention, the elastic member 1 which has the looped pockets 3 formed between the inner and outer peripheral surfaces thereof, the looped pockets extending towards the opposite end of the elastic member 1 and having ports 2 at the side of the inner peripheral surface, is inlaid in the outer periphery of the shaft 4 provided with the passage 6 for the pressure fluid at the central portion thereof such that at least the inner peripheral surfaces at the opposite ends of the elastic member 1 closely contact the shaft 4, with the elastic ring 10 harder than the elastic member 1 being brought into contact with the elastic member 1 at the opposite end faces, and further, the elastic member 1 and the elastic ring 10 are adhesively covered with the cover tube 13 at the outer periphery thereof. Moreover, the metal washer 11 of a smaller diameter than the cover tube 13 is pressed against the end face of the elastic member 1 by the fixture 12 which is smaller in diameter than the metal washer 11 from outside at the end portions of the elastic ring 10 and the cover tube 13. Therefore, when the crushing device of the present invention is inserted into the borehole B in the object A to be crushed as shown in FIG. 3, and a pressure fluid is sent into the passage 6 formed in the shaft 4 from a supply source T (not shown) by a pump P, the pressure fluid L flows out to the looped pockets 3 of the elastic member 1 through the ports 2, thereby expanding the elastic member 1, as shown in FIG. 5, due to the pressure of the fluid supplied into the looped pockets 3. This expensive force enables crushing of the object A such as a rock or concrete having scanty resiliency, without generating blasting noises. Furthermore, the generation of vibrations and/or dust which is inevitable with a crushing operation can be remarkably limited, thus ensuring safety in the crushing operation. Moreover, since the pressure within the looped pockets 3 becomes high due to the injection of the pressure fluid during the crushing operation, the elastic member 1 at the side of the outer peripheral surface is subjected to an outward expanding action, and at the same time, the elastic member 1 at the side of the inner peripheral surface is loaded with such force as to press the inner peripheral wall 1*a* against the outer periphery of the 4. Therefore, the inner peripheral portion of the elastic member 1 at the opposite ends thereof is firmly and closely adhered to the outer periphery of the shaft 4, such that the pressure fluid can be effectively prevented from leaking. Furthermore, the elastic ring 10 which is harder than the elastic member 1 in contact with end face of the elastic member 1 is pressed against the elastic member 1 by the fixture 12 of a smaller diameter than the elastic ring 10 through the metal washer 11, and accordingly, the expansion of the elastic member 1 towards the end faces thereof because of the injection of the pressure fluid can be prevented by the elastic ring 10. At the same time, since the elastic ring 10 is made of an elastic material, the elastic ring 10 is able to follow the expansion of the elastic member 1.

Therefore, even if the end face of the outer periphery of the elastic ring 10 protrudes towards the metal washer 11 backed up by the fixture 12, the elastic member 1 can work normally, without any extraordinary change in the configuration thereof, thereby improving the durability of the elastic member 1. Further, the crushing device of the present invention has a lot of useful effects, for example, the capability of repeated use only with exchange of the elastic ring 10.

The crushing device according to the present invention may be modified, in addition to the first embodiment, into various embodiments as will be described hereinbelow.

Figure 7:
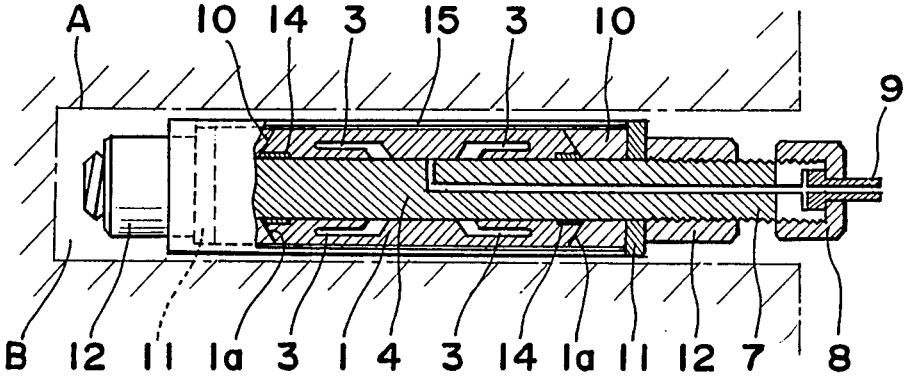

A crushing device shown in FIG. 7 comprises an elastic member 1 of a cylindrical configuration which has a looped pocket extending towards the end portions from ports 2 formed at the inner peripheral surface thereof, a shaft 4 provided with a fluid passage which has an outlet at the inner peripheral surface of the elastic member 1, the elastic member 1 being inlaid in the outer periphery of the shaft 4, and a cover sheet 15 in the form of a flexible sheet of a tubular shape which is wound around the whole outer periphery of the elastic member 1 in place of the cover tube 13 employed in the first embodiment.

The sheet 15 wound around the outer periphery of the elastic expansive member 1 is provided to prevent the elastic member 1 from being damaged after it is pressed directly against the object to be crushed such as rock, when in use, that is, when it is expanded within the borehole B formed in the object to be crushed. For the purpose of meeting the expansion of the diameter of the elastic member 1, the cover sheet 15 is formed into a spiral shape, or it is wound up such that at least both end portions of the protective sheet be overlapped around the elastic member 1. For this cover sheet 15, there are favorably employed such flexible sheets as metal sheets, plastic sheets, fiber woven sheets or non-woven cloths.

As is clear from the above description, the crushing device according to the present embodiment is so constructed that the elastic member 1 of a cylindrical shape provided with looped pockets 3 extending towards the end portions from openings formed at the inner peripheral surface is inlaid with the outer periphery of the shaft 4 having the fluid passage 6 with the outlet 5 opening at the inner peripheral surface of the elastic member 1, with the cover sheet 15 of a flexible sheet being wound around the outer periphery thereof. Accordingly, when a pressure fluid is injected from a fluid supply source (not shown) into the fluid passage 6, the elastic member 1 expands in the direction of the outer diameter thereof, the force of which expansion acts on the object to be crushed through the cover sheet 15, and thereof, the object to be crushed such as a rock A can be crushed with a reduced amount of noise and vibrations. Moreover, since the inner peripheral wall of the looped pockets 3 is pressed against the shaft 4 through injection of the fluid into the looped pocket 3, the elastic member 1 is closely adhered to the shaft 4 with increased strength, and accordingly, the pressure loss of the fluid can be prevented with assured prevention of leakage of the pressure fluid in the axial direction of the elastic member 1.

In addition, even when the wall face of the borehole into which the crushing device is inserted has a crack in the process of crushing the object by the use of the expansive force of the elastic member 1, or at the moment of crushing, it is effectively prevented because of the fact that the cover sheet 15 is wound around the outer periphery of the elastic member 1 that a part of the outer peripheral surface of the elastic member 1 comes in the crack, and the part of the elastic member 1 comes into the crack crushes, thereby improving the useful life of the elastic member 1.

Figure 8:
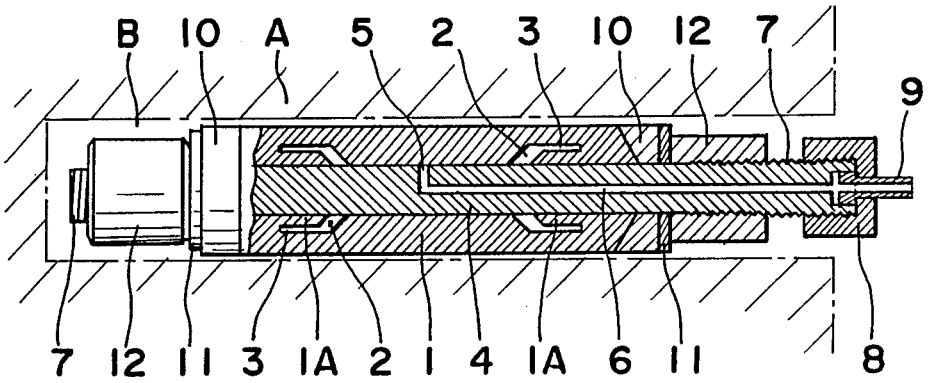

A crushing device shown in FIG. 8 does not employ the cover tube 13 which is used in the crushing device of the first embodiment. Specifically, the crushing device of FIG. 8 is constructed in the manner that a elastic member 1 which has looped pockets 3 formed between the inner and outer peripheral surfaces of the elastic member 1 and extending towards the opposite ends of the elastic member 1 is inlaid into the outer periphery of the shaft 4 provided with the fluid passage 6 at the central portion thereof so that at least the inner peripheral surfaces of the elastic member 1 at the opposite ends thereof closely contact the shaft 4, and further, the elastic ring 10 harder than the elastic member 1 is brought into pressed contact with the opposite end faces of the elastic member 1 by the fixture 12 having a smaller diameter than the elastic ring 10.

Figure 9:
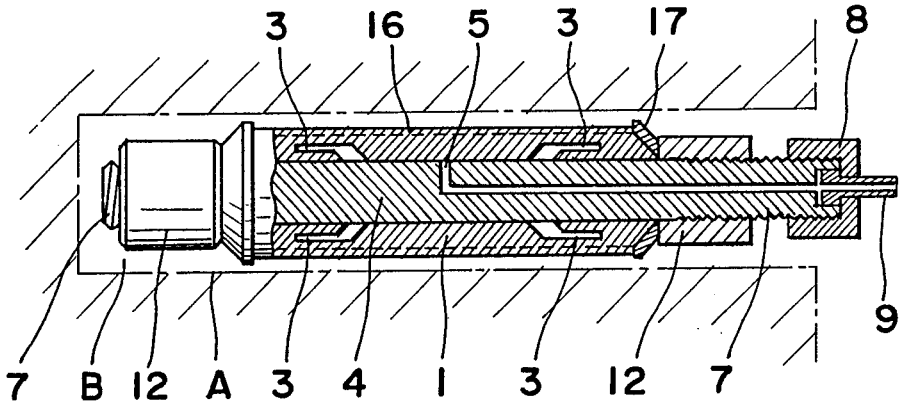

According to a further embodiment shown in FIG. 9, the crushing device is characterized in that the cover tube 13 is integrally formed with the elastic member 1 at the outer peripheral surface of the elastic member, as a reinforcement material 16, and simultaneously with this, a spring washer 17 of a conical type is employed in place of the elastic ring 10 of the first embodiment. In other words, both the elastic member 1 embedded in the outer periphery of the shaft 4 and the shaft 4 are, according to this embodiment, screwed into male screws provided at the end portions of the shaft, and integrally formed into one unit at a predetermined position by a fixture 12 which has the spring washer 17 inserted between the nut and the elastic member 1 so that the spring washer is in contact with the end face of the elastic member 1, and therefore, the member 1 can be prevented from expanding in the axial direction thereof when in use.

As for the above-described extendable reinforcing material 16 embedded at the side of the outer peripheral surface of the elastic member 1, a bias cord, woven fabric, wire-netting or other extendable synthetic fiber cloth may be used, which should be embedded into the shape of a cylinder in a parallel relation to the outer peripheral surface of the elastic member 1, while preventing the partial expansion of the elastic member 1.

As is fully described in the foregoing description, since the crushing device of the present embodiment is reinforced by the reinforcing material 16 embedded at the side of the outer peripheral surface of the elastic member 1, even when there exists a crack or crevice in the crushing device itself or in the borehole B into which the crushing device is inserted in the process of crushing the rock or the like by the utilization of the expansion pressure of the elastic member 1, or even when a part of the outer peripheral surface of the elastic member 1 comes into the above crack, the elastic member 1 is effectively prevented from partially expanding to a "burst", and thus the service life of the elastic member is increased. Moreover, the crushing device of the present embodiment is practically useful since only the elastic member 1 is to be exchanged with a new one in the case where it is damaged.

Figure 10:
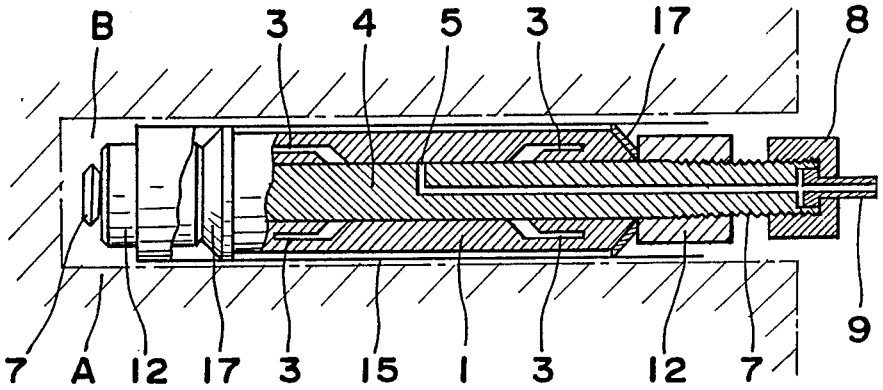

A crushing device of FIG. 10 employs both the spring washer 17 of FIG. 9, and the flexible cover sheet 15 of FIG. 7.

Figure 11:
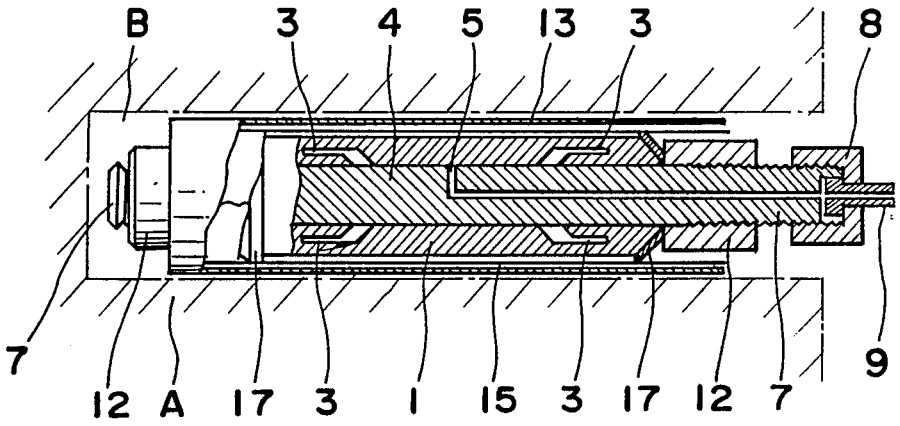

A crushing device of FIG. 11 is of the type in which the cover sheet 15 shown in FIG. 10 is further covered with an elastic tube such as, for example, a rubber tube. According to this embodiment, the elastic cover tube 13 is expanded in diameter simultaneously with the expansion of the elastic member 1 when in in use, and at the same time, the former is reduced in diameter simultaneously with the contraction of the elastic member 1 when the crushing operation is completed. Therefore, the crushing device of the instant embodiment is advantageous in that it is prevented from remaining within the borehole B, while the protection cover sheet 15 is still expanded in diameter, when the crushing device is to be removed after the completion of the crushing operation.

Figure 12:
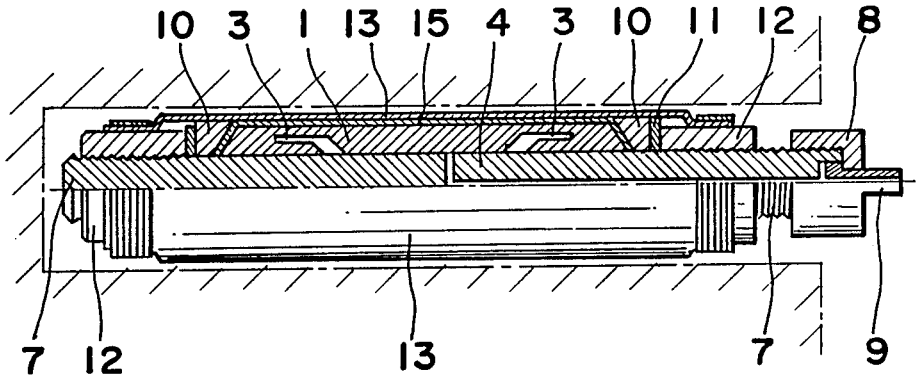

Referring now to FIG. 12, there is shown a still further embodiment of the crushing device wherein the cover sheet 15 is fixedly fastened at both ends thereof by the metal washer 11 and the fixture 12 through the looped elastic ring 10 made of, for example, synthetic resin, the outer periphery of which is covered with the cover tube 13.

Figure 13:
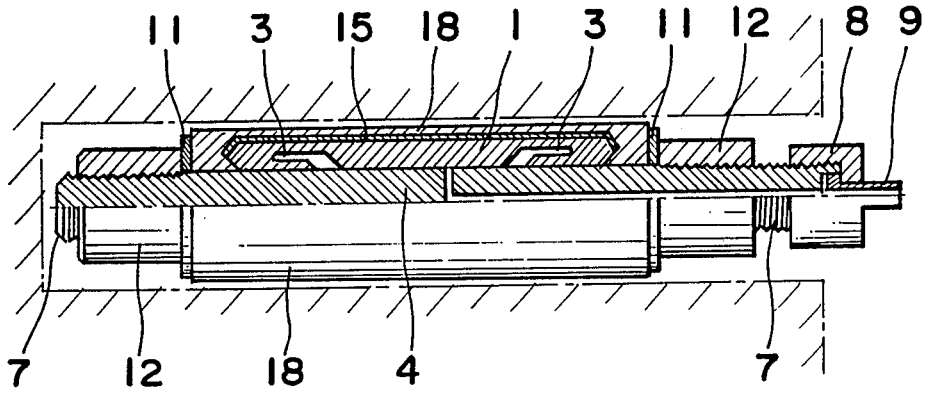

In FIG. 13, a crushing device is shown in accordance with yet a further embodiment wherein an elastic molded member 18 in a pipe-like configuration, functioning as the cover tube 13 covering the cover sheet 15, is integrally formed with the elastic ring 10 over the whole outer peripheral surface of the elastic member 1, and both the cover sheet 15 and the molded member 18 are fastened to the surface of the elastic member 1 by the metal washer 11 and the fixture 12. In this embodiment as in the other embodiments described earlier, the molded member 18 and the cover tube 15 are increased in diameter concurrently with the expansion of the elastic member 1 in the crushing operation, while they are reduced in diameter simultaneously with the contraction of the elastic member 1, and accordingly, they are easily removed from the borehole after completion of the crushing operation.

As is clear from the foregoing description, the crushing device of the present invention comprises a cylindrical elastic member provided with at least one pair of looped pockets having associated ports, a metal shaft in which the elastic member 1 is inlaid and to the outer peripheral surface of which are closely communicated with the ports of the elastic member, with elastic rings being mounted onto the shaft in contact with the end faces of the elastic member, and a fluid injection passage formed in the axial direction of the metal shaft extending from one end thereof to communicate to the looped pockets formed between the inner and outer peripheral surfaces of the elastic member such that, by injecting a fluid into the looped pockets through the fluid passage, the elastic member is expanded in the direction of an outer periphery thereof, and accordingly, the elastic member expands only in the sectional direction of the borehole formed in the rock or concrete while being restrained from expanding in the longitudinal direction thereof by the elastic rings secured to the shaft at both end faces. Thus, in the crushing device of the present invention, the rock or concrete can be easily crushed by a large pressure produced in proportion to the area of the outer periphery of the elastic member by the pressure fluid pressed into the looped pocket. Moreover, according to the present invention, since the rock or concrete can be crushed only by injecting a fluid by a pump into the looped pocket after insertion of the crushing device into the borehole, the crushing operation can be carried out speedily, without causing such unfavorable influences to the operational environments such as noise and/or vibrations.

Furthermore, since the crushing device of the present invention can be reused, the crushing operation can be performed highly efficiently and economically.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A device for crushing a rock by inserting said device into a borehole formed in said rock, comprising:
   - a cylindrically shaped expandable elastic member having cavities formed therein;
   - a shaft partially encompassed by said elastic member and having a fluid passage formed therein, one end of said fluid passage being connected to a pressure fluid source and the other end thereof communicating with said elastic member for permitting expansion of said expandable member by conveyance of fluid from said source to said cavities so as to crush said rock;
   - fixtures mounted on said shaft at end portions thereof for preventing said elastic member from expanding along an axial direction of said shaft upon conveyance of said fluid; and
   - metal rings separate from said shaft, and embedded at respective end portions of said elastic member for preventing said elastic member from warping at said end portions upon conveyance of said fluid.

2. The device as defined in claim 1, further comprising elastic rings each having almost the same diameter as said expandable elastic member and provided between said fixtures and said elastic member for preventing said elastic member from expanding beyond said fixtures.

3. The device as defined in claim 2, wherein said elastic rings are constructed of materials harder than the material of said elastic member, and the end portion of each of said elastic rings which is fitted to a corresponding end of said elastic member is tapered to form a conical plane of which one end having a small diameter is positioned close to said fixture, while the other end of the conical plane having a larger diameter is positioned further from said fixture.

4. The device as defined in claim 2, further comprising washers positioned between said fixtures and said elastic rings.

5. The device as defined in claim 4, wherein said washers and said fixtures are integrally formed.

6. The device as defined in claim 4, further comprising a cover sheet formed over the periphery of said elastic member and fastened at both ends thereof with said washers and said fixtures through said elastic rings, and a tube covering said cover sheet.

7. The device as defined in claim 4, further comprising a cover sheet formed over a portion of the periphery of said elastic member and a molded member integrally formed with said elastic rings over the whole outer peripheral surface of said elastic member and said cover sheet, said cover sheet and said molded member being fastened to said elastic member via said washers and fixtures.

8. The device as defined in claim 1, further comprising a tube for covering the whole outer periphery of said elastic member so as to reinforce the strength of said elastic member.

9. The device as defined in claim 8, wherein said tube is made of materials including reinforcing elements therein.

10. The device as defined in claim 8, wherein said tube is integrally formed with said elastic member at the outer surface of said elastic member, and further comprising spring washers formed between said fixtures and said elastic member for preventing said elastic member from expanding beyond said fixtures.

11. The device as defined in claim 1, further comprising a sheet for covering the whole outer periphery of said member so as to reinforce the strength of said elastic member.

12. The device as defined in claim 11, wherein said sheet is constructed of a sheet of flexible materials.

13. The device as defined in claim 11, further comprising spring washers formed between said fixtures and said elastic member for preventing said elastic member from expanding beyond said fixtures.

14. The device as defined in claim 13, further comprising a tube formed over said cover sheet.

15. The device as defined in claim 1, wherein said elastic member includes reinforcing wires embedded therein at a position close to the outer periphery thereof.

16. The device as defined in claim 1, wherein one end of said fluid passage is in direct communication with one of said cavities.

17. The device as defined in claim 1, wherein said cavities are L-shaped and extend away from the center of said elastic members so as to form ports therein.

18. The device as defined in claim 1, wherein said shaft is threaded at both ends to secure said fixtures.

19. The device as defined in claim 1, wherein said metal rings are embedded integrally within said elastic member.

20. The device as defined in claim 1, wherein said metal rings are embedded completely into said elastic member.

21. A device for crushing a rock by inserting said device into a borehole formed in said rock, comprising:
   - a cylindrically shaped expandable elastic member having cavities formed therein;
   - a shaft partially encompassed by said elastic member and having a fluid passage formed therein, one end of said fluid passage being connected to a pressure fluid source and the other end thereof communicating with said elastic member for permitting expansion of said expandable member by conveyance of fluid from said source to said cavities so as to crush said rock;
   - fixtures mounted on said shaft at end portions thereof for preventing said elastic member from expanding along an axial direction of said shaft upon conveyance of said fluid;
   - metal rings separate from said shaft, and embedded at respective end portions of said elastic member for preventing said elastic member from warping at said end portions upon conveyance of said fluid;
   - elastic rings each having almost the same diameter as said elastic member and provided between said fixtures and said elastic member for preventing said elastic member from expanding beyond said fixtures;
   - washers positioned between said fixtures and said elastic rings; and
   - a tube for covering the whole outer periphery of said elastic member so as to reinforce the strength of said elastic member.

22. A device as defined in claim 21, wherein one end of said fluid passage is in direct communication with one of said cavities.

* * * * *